United States Patent [19]

Kotzur

[11] 4,367,853

[45] Jan. 11, 1983

[54] GUIDE AND SUPPORT MEMBERS FOR UNWINDING FLEXIBLE MATERIAL FROM A WOUND PACKAGE

[75] Inventor: Frank W. Kotzur, Mahopac, N.Y.

[73] Assignee: Windings, Inc., Goldens Bridge, N.Y.

[21] Appl. No.: 328,224

[22] Filed: Dec. 7, 1981

[51] Int. Cl.[3] ..... B65H 55/02

[52] U.S. Cl. ..... 242/163

[58] Field of Search ..... 242/163, 170, 171, 172, 242/159, 132, 137, 137.1, 138, 141, 146

[56] References Cited

U.S. PATENT DOCUMENTS

| | | | |
|---|---|---|---|
| 3,677,491 | 7/1972 | Gerwig | 242/163 |
| 3,689,005 | 9/1972 | Newman | 242/163 |
| 3,705,698 | 12/1972 | Newman et al. | 242/163 X |
| 3,877,661 | 4/1975 | Newman | 242/163 |
| 3,923,270 | 12/1975 | Newman et al. | 242/163 |

*Primary Examiner*—Stanley N. Gilreath

*Attorney, Agent, or Firm*—Watson, Cole, Grindle & Watson

[57] ABSTRACT

A package for a wind of flexible material wound with a universal wind and having a radial opening into the axial opening through which the inner end of the material is brought out is provided with specially shaped cones having end portions extending into the inner end of the radial opening to guide the material to prevent tangles and birdnesting during unwinding of the wound material. The end portions of the specially shaped cone members may be inserted into the end portion of the payout tube which, in turn, is inserted within the radial opening of the wound package.

5 Claims, 8 Drawing Figures

GUIDE AND SUPPORT MEMBERS FOR UNWINDING FLEXIBLE MATERIAL FROM A WOUND PACKAGE

BACKGROUND OF THE INVENTION

1. Field of the Invention

The invention is directed to a guide structure to stabilize flexible material as it is unwound from a winding, and in particular to such structure which is inserted in the axial core of a universal wind wound with a radial opening extending from the exterior of the wind to the inner core to prevent entanglement of the material as it is unwound through the radial opening.

2. Prior Art

When paying out material from the inside of a winding through a radial opening therein it is often desirable to use some means to guide the material to help prevent entanglement thereof as the material is being unwound from the inside of the winding through the radial opening. Exemplary of such prior art are U.S. Pat. Nos. 3,677,491, 3,689,005, 3,877,661 and 3,923,270, all of which have been assigned to the same Assignee as the present invention. In U.S. Pat. No. 3,677,491, the coils being pulled off of the interior of the wind are controlled by inwardly tapering members, such as truncated pyramids, which project inwardly from the end walls of the box within which the wound package is contained. In U.S. Pat. No. 3,689,005, generally conically shaped members having rounded points extend into the axial space within the package from each end. The tips of the conical members are spaced apart by a distance which is only slightly greater than the greatest cross-sectional dimension of the flexible material. The conical members are supported to be out of contact with the flexible material. The package of flexible material in accordance with U.S. Pat. No. 3,877,661 is mounted on opposed conical members which are directed towards each other and which are inserted into the ends of the axial space within the wound package. The package of flexible material in accordance with U.S. Pat. No. 3,923,270 utilizes tapering members which are inserted within the axial opening of the wound package to guide the individual coils of the material as they are withdrawn, as well as to prevent inward collapse of the winding during shipment or handling thereof. Additionally, solid material is inserted in the space between the cones and the inner wall, which material is moved prior to the unwinding of the wound material.

FIG. 1 illustrates the manner in which prior art guides have been inserted within a wound package. As illustrated in FIG. 1, the guide members comprise spaced cones 10, 12 which are inserted opposite the ends of the inner core 14 of wound package 16. These types of cone members help prevent flexible material 18 from slipping from the top half of the coil to the bottom half of the coil. When a loop of wound material breaks free from the wall of the winding, it rests on the cone members 12, 14 as illustrated in FIG. 1. As the material is paid out through radial opening 20, the loops become smaller and smaller. At some point during the payout, the torsion in the loops caused by the small radius will cause a loop on the opposite side to break free. In many instances, the flexible material is such that the one-half twist of the first loop will meet the one-half twist of the second loop and since they are in opposite directions, the twist will cancel each other out. However, such is not always the case and sometimes the whole first loop will move into the region of the second loop. Since the second loop radius is the larger, it can tangle with the first loop and cause a slip-knot to be formed in the flexible material. Moreover, another possibility is that one of the loops can lasso the payout tube 22.

SUMMARY OF THE INVENTION

In the present invention, the cone members are shaped so as to extend closely adjacent to, or at least partially into, the radial opening of the wound package, thereby preventing a meeting of the first and second loops of the coil. In a preferred embodiment of the invention, each of the cone members is scimitar-shaped and has end portions which extend at least partially into the radial opening of the winding, with each scimitar-shaped cone being mounted in a respective end portion of the axial opening of the winding.

Thus, a primary object of the invention is to provide specially shaped guide members which prevent entanglement of flexible material as it is being unwound from the inside through a radial opening in the winding which is wound in a universal wind configuration.

A further object of the present invention is to provide guide members of the type specified herein which are so shaped to enable the flexible material to lie on the guide members until they reach the entrance of the radial opening of a universal wind during the unwinding process.

And yet a further object of the present invention is to provide an improved package of wound material wound in a universal type wind with a radial opening extending from the exterior of the wind into an axial opening and which includes specially shaped guide members for guiding the flexible material as it is unwound through the radial opening to prevent entanglement of the flexible material.

BRIEF DESCRIPTION OF THE DRAWINGS

The above objects, features and advantages of the invention will be readily apparent from the following description of a preferred embodiment of the invention representing the best mode of carrying out the invention when taken in conjunction with the following drawings, wherein.

DETAILED DESCRIPTION OF THE PREFERRED EMBODIMENTS

Figure 1:
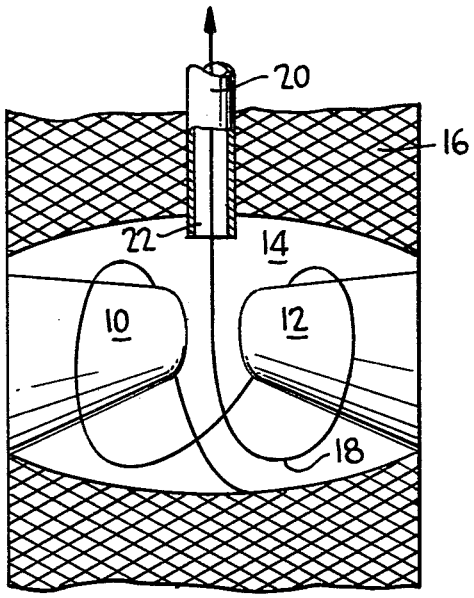
FIG. 1 (PRIOR ART)
FIG. 1 represents a prior art configuration of cone members for guiding flexible material into the radial opening of a winding.
Figure 2:
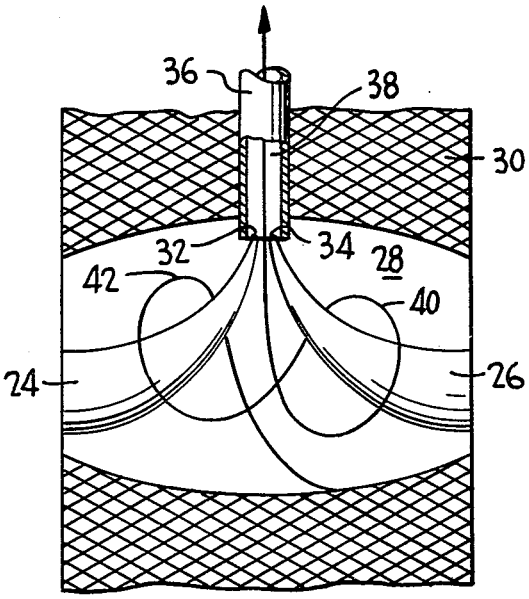
FIG. 2 illustrates an embodiment of specially-shaped guide members in accordance with the invention.

In the embodiment of the invention illustrated in FIG. 2, a pair of scimitar-shaped cone members 24, 26 are positioned within the axial opening 28 of flexible winding 30 such that the respective end portions 32 and 34 of the cone members extend at least partially into the interior of payout tube 36 which is inserted within the radial opening 38 of the winding 30. With cones shaped as illustrated in FIG. 2, i.e., having generally curved surfaces that guide the flexible material to the payout tube 36, and whose ends 32, 34 are at least partially inside the payout tube, or having ends which are so near the mouth of the payout tube, that the first loop 40 of the flexible material cannot pass into the vicinity or region of the second loop 42 of flexible material. An added advantage of the configuration of the cone or guide members as illustrated in FIG. 2, is that if the material is paid out with the radial opening 38 vertical, and if the flexible material should break loose around the payout tube 36 (which is the most likely place since the crossovers are nearer the tube and the loop radius must usually become small to remove the material from the winding wall) it will tend to lie on the surfaces of scimitar-shaped cones 24 and 26 until it is time for the first and second loops 40, 42, respectively, to be pulled through the radial opening 38.

Figure 3:
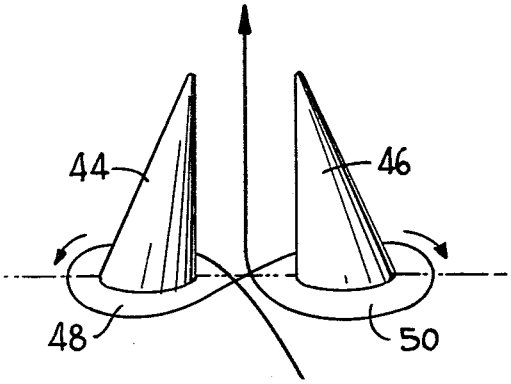
FIGS. 3–5 respectively illustrate different problems that are overcome by the specially-shaped guide members of the present invention.
Figure 8:
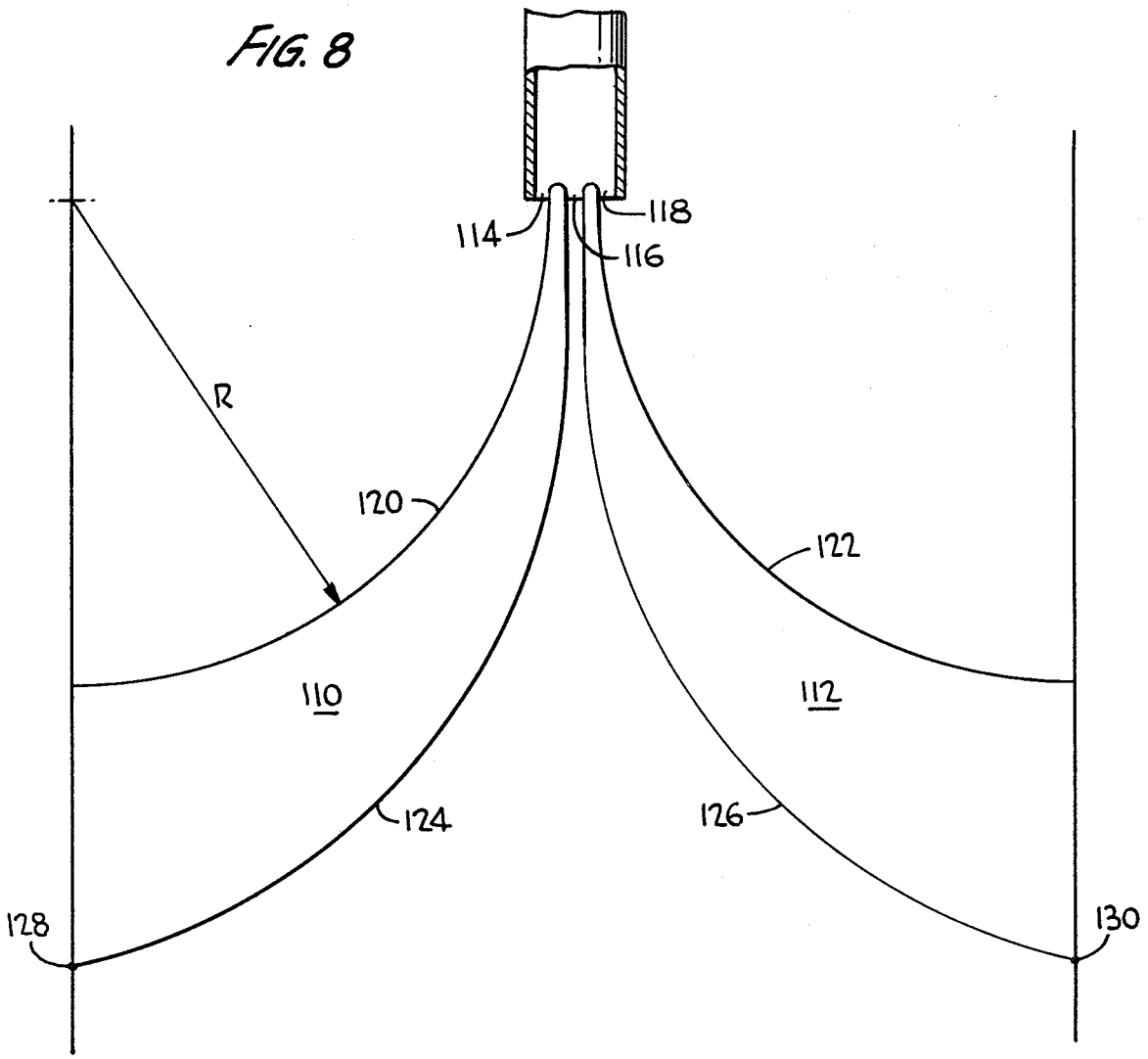
FIG. 8 represents another preferred embodiment of the invention illustrating the positioning of the end portions of the specially-shaped guide members with regard to the radial opening of the winding.

FIG. 3 shows a Figure-8 wind around two cone-shaped posts 44, 46, such that loops 48 and 50 lie on a flat surface so that the planes of the loops make an angle of 180°. Loop 48 is laid down first around cone 44 in a counterclockwise direction, back over itself, clockwise around cone 50, then out of the package as illustrated by the arrow. The universal winding of which the package of the present invention is composed is made of such figure-8s spaced some distance apart. The crossovers and loops are laid out flat for clarity. However, in actual practice, the crossovers are spaced radially about the center axis of the winding mandrel, and all of the loops are wound concentrically.

Figure 4:
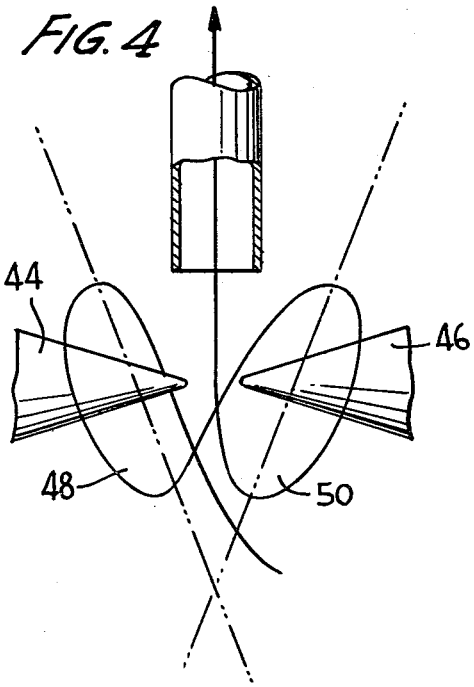

FIG. 4 illustrates cone-shaped posts 44, 46 in orientation such that the respective points or end portions are facing one another. The material loops 48, 50 form planes that intersect at some angle less than 180° as illustrated in the Figure.

Figure 5:
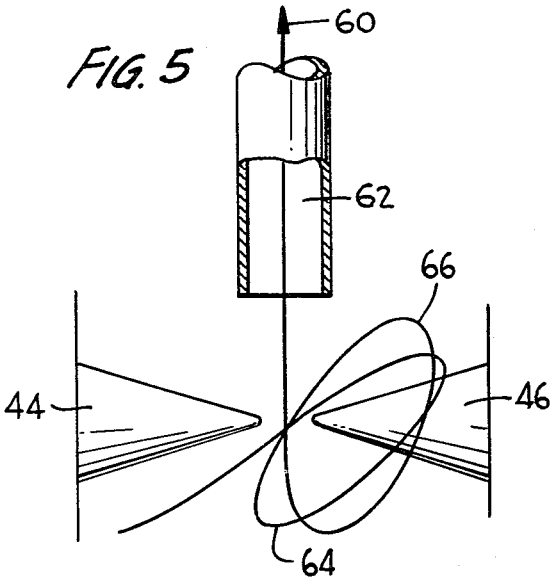

FIG. 5 illustrates a possible situation in which a tangle can develop in the flexible material 60 as it is being passed through tube 62 which is inserted within the radial opening of the winding. As illustrated in the Figure, loop 64 has fallen over into the region of loop 66. If loop 66 does not fall outwardly as shown by the arrow, it will possibly entangle with loop 64. This will cause a slip-knot in the flexible material and will hinder or even prevent its being pulled through tube 62.

Figure 6:
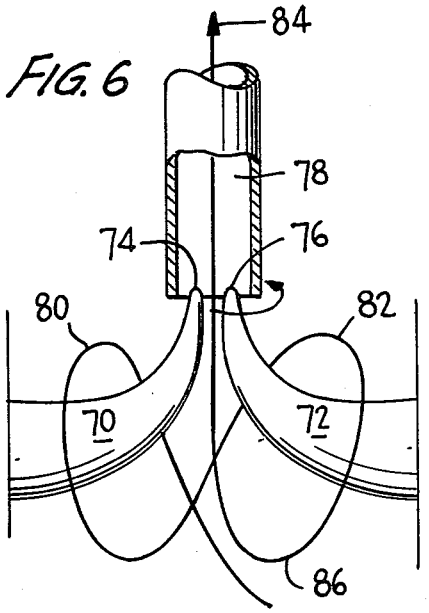
FIG. 6 illustrates the principle of operation of the specially-shaped cones of the present invention.

FIG. 6 illustrates the difference that is produced by the present invention in which the respective cone points are pointed towards the payout hole. As illustrated in FIG. 6, scimitar-shaped cone members 70, 72 have respective end portions 74, 76 which have been turned near or even into the mouth of payout tube 78. Therefore, loop 80 of flexible material will be prevented from winding up in the region of loop 82 as the flexible material 84 is paid out through tube 78 which has been inserted into the radial opening of the wound package. It should be noted that the surfaces of cone or guide members 70, 72 should be as smooth as possible. They can be flat or horn-shaped as in a cone that has been bent. The curve of the cone shape that faces the payout hole must have a sufficient concave curvature so as to be "transparent" to the normal motion of the flexible material and it is being unwound. Additionally, it is necessary that the space between the payout tube 78 and the cones must be large enough to allow the material (not the loop itself) to be free to move from side-to-side within the payout tube. It is noted that in FIG. 2, or FIG. 6, the wound material can pass around the sides of the cone, but the loops cannot pass over the end points of the cone members.

As can be clearly seen from that which is illustrated in FIG. 6, when the flexible material 84 is paid out, loop 82 will become smaller. As this loop becomes small, the forces necessary to make the loops smaller yet will cause the flexible material at the mouth of payout tube 78 to move to the right. Because loop 80 extends into the surface of the drawing as it becomes smaller, the flexible material will then move around the circumference of the inside dimension of the payout tube as illustrated by the arrow in FIG. 6. The loops of flexible material will actually hold it from flipping to the rear of the package (as viewed from the paper) until the part 86 of loop 82 is clear of scimitar-shaped cone 72 itself. Once this occurs, loop 82 is virtually gone anyway and cannot possibly tangle with loop 80.

Figure 7:
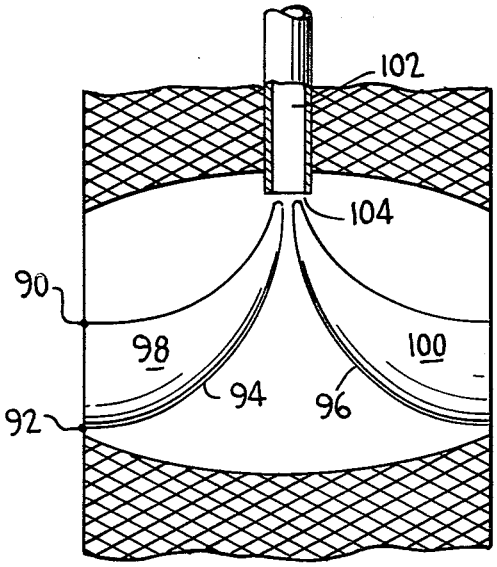
FIG. 7 represents another preferred embodiment of the present invention and illustrating the relationship of the specially-shaped guide members with regard to the axial opening in the winding and the radial opening of the winding.

With reference to FIG. 7, the cones of the invention appear to function best when the concave side of the cone starts approximately at center line CL of the axial opening of the package, or closer to point 90. The opposite side of the cone can then only start at point 92 since the mandrel size dictates the size of the axial opening and thus the size of the cone that can be inserted therein. The curved portions 94, 96 of cones 98, 100 must be gentle enough to allow the flexible material to be drawn to the payout tube. The curvature of the concave portions of cones 98, 100 can be a portion of a circle having a curve approximately tangent to a line drawn parallel to the payout tube 102 at point 104 which is at or near the mouth of the payout tube.

FIG. 7 also illustrates another preferred embodiment in which the end portions of cones 98 and 100 are pointed towards the radial opening at point 104, but are not actually within the radial opening as is the case with the embodiments illustrated in FIGS. 2 and 8.

The following example assumes that a coil is wound of flexible material having a 0.080 inch OD on an eight inch mandrel (end diameter of $6\frac{1}{2}$ inches), the coil is nine inches wide and the payout tube is three-quarters of an inch ID.

As illustrated in FIG. 8, the payout tube diameter is divided into five equal parts. Three parts are for the flexible material and two parts are for the end portions of the scimitar-shaped cones 110, 112. With the above dimensions, the cones can take up 0.150 inches each and the three spaces that the flexible material is allowed to move in are also 0.150 inches. The flexible material can easily slip through spaces 114, 116 and 118. Curved portions 120, 122 of scimitar-shaped cones 110, 112 are computed from the coil width divided by two minus half the tube ID plus the clearance of 0.150 inches. In other words, $$R=(9\div 2)-0.375+0.150=4.275 \text{ inches.}$$

This forms an arc as illustrated in FIG. 8. Curved or arc portions 124 and 126 of respective cones 110, 112 are drawn to be smooth since there is no serious effect of the shape of this curve, with the exception that it must not be too steep when it begins at points 128 and 130 as the flexible material must travel up each of the surfaces of cones 110 and 112. If the angle of surface portion 124 and 126 is too steep, the flexible material will simply "run" at those portions, thereby backing twists into the package of wound material.

It is, therefore, desired that the present invention not be limited to the embodiments specifically described, but that it include all such modifications and variations that would be obvious to those skilled in this art. The scope of my invention should be determined by the equivalents of the various terms as recited in the following annexed claims.

What is claimed is:

1. A package of flexible material comprising a plurality of layers each formed of a plurality of figure-8 winds with the crossovers of the winds progressing around the package, said package having a radial opening therein, and having an axial opening into which said radial opening extends, and the free inner end of said flexible material being let out through said radial opening, said package further including a pair of inwardly tapering members extending into said axial opening and each tapering member including an end portion positioned closely adjacent and pointed towards the inner opening of said radial opening so as to guide loops of material withdrawn from the package for payout through said radial opening.

2. A package of flexible material as claimed in claim 1 wherein each said end portion extends partially into said radial opening.

3. A package as claimed in claim 1 or 2 wherein each of said tapering members include a base portion and the surface between said base portion and each of said respective end portions is gently sloping.

4. A package of flexible material as claimed in claim 3 wherein the respective end portions are spaced within said radial opening by a distance equal to a distance between a respective end portion and the side wall of said radial opening.

5. A package of flexible material as claimed in claim 4 wherein each of said tapering members is scimitar-shaped from said base portion to each respective end portion.

* * * * *